US006598809B1

(12) United States Patent
Reiter et al.

(10) Patent No.: US 6,598,809 B1
(45) Date of Patent: Jul. 29, 2003

(54) FUEL-INJECTION VALVE

(75) Inventors: Ferdinand Reiter, Markgröningen (DE); Heinz-Martin Krause, Markgröningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/284,892

(22) PCT Filed: Jun. 17, 1998

(86) PCT No.: PCT/DE98/01648

§ 371 (c)(1),
(2), (4) Date: Jul. 12, 1999

(87) PCT Pub. No.: WO99/10650

PCT Pub. Date: Mar. 4, 1999

(30) Foreign Application Priority Data

Aug. 22, 1997 (DE) ..... 197 36 548

(51) Int. Cl.[7] ..... B05B 7/12; B05B 1/30; F02M 51/00

(52) U.S. Cl. ..... 239/408; 239/585.1; 239/585.3; 239/585.4; 239/585.5

(58) Field of Search ..... 239/585.1, 585.3–585.5, 239/596, 601, 900, DIG. 19, 408; 277/476–480, 366–369, 350, 385, 616, 623, 637, 627; 285/319, 379

(56) References Cited

U.S. PATENT DOCUMENTS 2,587,888 A * 3/1952 Phillips ..... 277/478
4,548,361 A * 10/1985 Paschke ..... 239/585.3
4,597,558 A * 7/1986 Hafner et al. ..... 251/129.05
4,666,088 A * 5/1987 Krauss et al. ..... 239/533.12
4,951,878 A * 8/1990 Casey et al. ..... 239/462
5,193,743 A 3/1993 Romann et al. ..... 239/1
5,273,215 A * 12/1993 Hans et al. ..... 239/288.5
5,323,966 A * 6/1994 Buchholz et al. ..... 239/408
5,373,992 A * 12/1994 Reiter ..... 239/585.4
5,395,050 A * 3/1995 Nowak et al. ..... 239/121
5,662,277 A * 9/1997 Taubitz et al. ..... 239/585.4
5,826,804 A * 10/1998 Reiter et al. ..... 239/585.1
5,975,436 A * 11/1999 Reiter et al. ..... 239/585.1
6,012,701 A * 1/2000 Reiter ..... 251/129.1

FOREIGN PATENT DOCUMENTS

DE 41 21 372 12/1992
DE 42 05 709 8/1993
DE 195 05 886 8/1996

* cited by examiner

*Primary Examiner*—Davis D Hwu
(74) *Attorney, Agent, or Firm*—Kenyon & Kenyon

(57) ABSTRACT

The fuel-injection valve has the feature that provision is made at the downstream end of the injection valve for a preparation attachment which is made of a gas-containing part and an insertion member. The downstream end of the injection valve with the preparation attachment is completely surrounded in the circumferential direction by a tubular, thin-walled, metallic gas-containing member. The gas-containing member is secured to the injection valve by a non-integral snap-fit, catch or clip connection to a plastic extrusion coating at least partially enveloping the valve housing. The corresponding connection elements are constructed in the form of projections and clips. The fuel-injection valve is particularly suited for injection into the intake passage of a mixture-compressing internal combustion engine with externally supplied ignition.

13 Claims, 2 Drawing Sheets

FUEL-INJECTION VALVE

FIELD OF THE INVENTION

The present invention relates to a fuel-injection valve.

An electromagnetically operable valve for injecting a fuel-gas mixture into a mixture-compressing internal combustion engine with externally supplied ignition is described in German Patent No. 195 05 886, in which a plastic gas-containing member partially encloses the downstream end of the injection valve. Within the gas-containing member, provision is made at the downstream end of the injection valve for a preparation attachment which is composed of a metallic, cup-shaped gas-containing part and a plastic insertion body. The gas can stream in between the gas-containing member and the valve housing (valve-seat support), in order to then be fed to the fuel in the preparation attachment. The plastic gas-containing member, designed partially to be quite thick-walled, is permanently joined to the actual plastic extrusion coat of the valve by the use of an integrally retaining method such as ultrasonic welding.

German Patent No. 41 21 372 describes, a fuel-injection valve for injecting a fuel-gas mixture, in which a gas-containing sleeve surrounds a nozzle body of the valve at its downstream end. In this case, the metallic gas-containing sleeve is designed in such a way that its base part is formed with a passthrough opening at an angle toward the valve end. In this manner, an annular gas gap is formed between a spray-orifice plate and the base part of the gas-containing sleeve. The gas-containing sleeve is secured to the metallic nozzle body either by several welding points, by crimping, pressing, soldering or cementing. An annular groove-shaped accommodation for a gasket for sealing with respect to a valve mount is achieved by welding an additional, costly, U-shaped retaining ring at the outer periphery of the gas-containing sleeve.

SUMMARY OF THE INVENTION

The fuel-injection valve of the present invention, has the advantage that a particularly cost-effective gas-containing member is able to be mounted at the spray-side end of the valve in a simple manner. Advantageously used to that end as the joining partner of the metallic gas-containing member is the plastic extrusion coat, customary on the conventional injection valves, which must be minimally modified only in the actual joining area compared to conventional injection valves. A simple, and nevertheless secure attachment of the gas-containing member is attained by a non-integral joining technique. Problems which can occur when using integral joining techniques, such as negative heat effects, are completely avoided in the embodiment of the present invention.

It is advantageous to manufacture gas-containing members using deep drawing, thus allowing simple production of these components in large quantities.

It is particularly advantageous to form the non-integral connection as a snap-fit, catch, or clip connection, in which projections and clips interact as corresponding connection means.

The thin-walled and tubular gas-containing member is well suited for the direct formation of annular grooves for accommodating gaskets which are used for sealing off the injection valve with respect to a valve mount. At the outer periphery of the gas-containing member, transversely to its axial extension, outwardly disposed toruses can be produced very easily by folding. It is thus possible to dispense with additional U-shaped retaining rings.

DETAILED DESCRIPTION

Figure 1:
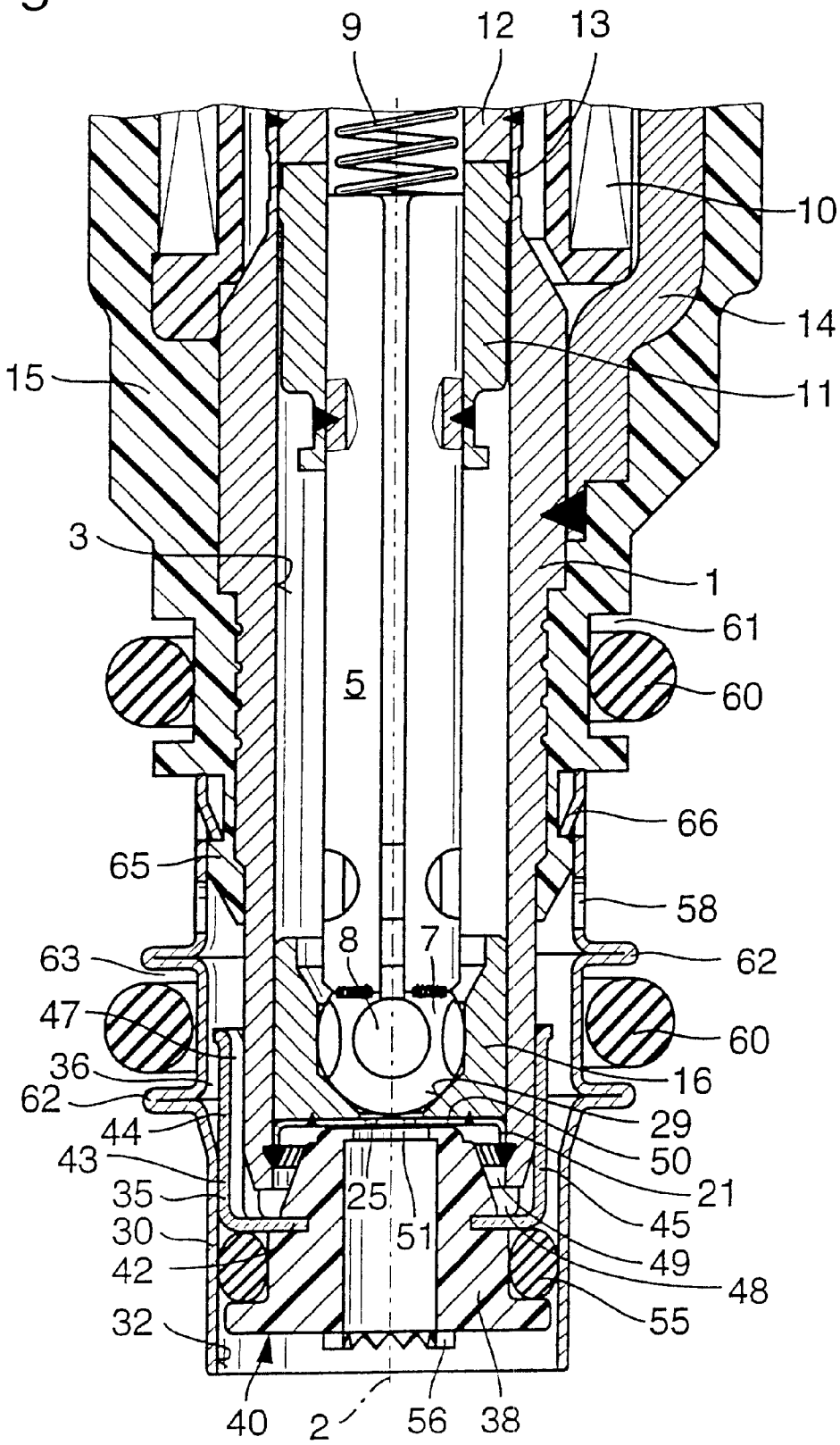
FIG. 1 shows a spray-side end of a fuel-injection valve as a first exemplary embodiment of a gas enclosure according to the present invention.

In FIG. 1, a valve in the form of an injection valve for fuel-injection systems of mixture-compressing internal combustion engines with externally supplied ignition is shown partially and simplified in cross-section. The injection valve has a substantially tubular, metallic, valve-seat support 1, at least partially forming a valve housing, in which is formed a longitudinal opening 3 concentrically to a longitudinal valve axis 2. Arranged in longitudinal opening 3 is a, for example, tubular valve needle 5 which, at its downstream end, is joined to a, for example, spherical valve-closure member 7, at whose periphery, for example, five flattenings 8 are provided.

The injection valve is actuated electromagnetically, in conventional manner. Used for the axial movement of valve needle 5, and thus for opening against the spring tension of a resetting spring 9 or for closing the injection valve, is an electromagnetic circuit having a magnetic coil 10, an armature 11 and a core 12. Armature 11 is joined with the assistance of a laser to the end of valve needle 5 facing away from valve-closure member 7 by, e.g., a welded seam, and is aligned with core 12. Magnetic coil 10 surrounds core 12 which, for example, represents the end of an intake nipple surrounded by magnetic coil 10, the intake nipple being used for feeding the medium, in this case fuel, to be metered in by the valve.

The electromagnetic circuit is closed, for example, by at least one U-shaped conductive element 14. Magnetic coil 10, embedded in a coil form, and the at least one conductive element 14, as well as broad sections of core 12 and of valve-seat support 1 are enclosed by a plastic extrusion coat 15 representing an outer jacketing member of the injection valve, an electrical plug connector, not shown, being directly sprayed on at the same time. Core 12 and valve-seat support 1 are securely joined to one another by, e.g., a circumferential welded seam in the area of the axial extension of magnetic coil 10, a magnetic restrictor 13 adjoining this connecting point downstream because of the thin-walled construction of valve-seat support 1. Instead of plastic extrusion coat 15, provision can also be made for a different jacketing member which at least partially forms the outer valve periphery, and which, for example, is constructed of metal as a jacket-type housing.

In the downstream end of valve-seat support 1, facing away from core 12, a cylindrical valve-seat member 16 is tightly mounted in longitudinal opening 3. At its one lower end face, facing away from valve-closure member 7, valve-seat member 16 is permanently and concentrically joined to a, e.g., pot-shaped spray-orifice plate 21. Valve-seat member 16 and spray-orifice plate 21 are joined, for example, by a circumferential and impermeable welded seam formed, e.g., by a laser. This type of assembly prevents the danger of an unwanted deformation of spray-orifice plate 21 in the area of its at least two, e.g., four spray orifices 25, formed by punching or eroding, which are centrally located in spray-orifice plate 21. In addition, spray-orifice plate 21 is permanently joined to valve-seat support 1 by, e.g., a circumferential and impervious welded seam.

The insertion depth of the valve-seat part, composed of valve-seat member 16 and pot-shaped spray-orifice plate 21, into longitudinal opening 3 determines the size of the stroke range of valve needle 5, since the one end position of valve needle 5, when magnetic coil 10 is not excited, is defined by the contact of valve-closure member 7 against a valve-seat surface 29 of valve-seat member 16. The spherical valve-closure member 7 interacts with valve-seat surface 29 of valve-seat member 16, valve-seat surface 29 tapering frustoconically in the direction of flow. The other end position of valve needle 5, when magnetic coil 10 is excited, is defined, e.g., by the contact of armature 11 against core 12. Thus, the travel between these two end positions of valve needle 5 represents the stroke.

At its downstream end, the injection valve, and thus valve-seat support 1, is enclosed to a great extent in the circumferential direction, and at least partially axially, by a sleeve-shaped, thin-walled gas-containing member 30. Gas-containing member 30, produced, e.g., from a sheet metal by deep drawing, is joined to the lower end of plastic extrusion coat 15. Arranged upstream of gas-containing member 30 is a gas-entrance channel, not shown, which is used to feed the gas into gas-containing member 30. Gas-containing member 30 has an inner feed-through opening 32, into which not only the downstream end of valve-seat support 1 with valve-seat member 16 projects, but in which further means are provided for the gas supply and delivery in the direction toward spray orifices 25. Thus, gas-containing member 30 surrounds, inter alia, a cup-shaped gas-containing part 35 in an intervening space 36 which is formed between gas-containing member 30 and valve-seat support 1, and which is directly-connected to the gas-entrance channel. Thus, the feeding of the gas to where the fuel emerges from spray-orifices 25 of spray-orifice plate 21 is assured.

Together with an insertion member 38, manufactured, e.g., from plastic, cup-shaped gas-containing part 35, as a sheet-metal part, forms a preparation attachment 40 completely enclosed in the axial direction by gas-containing member 30. Insertion member 38, which is distinguished by a largely conical shape, extends completely downstream of valve-seat member 16. On the other hand, gas-containing part 35, securely joined to insertion member 38, is constructed in such a way that a bottom section 42 is surrounded at least partially by material of insertion member 38 and projects radially from it, centrically for example, when viewed over the axial length of insertion member 38. Contiguous to bottom section 42 is a cylindrical, axially running jacket section 43 which, in the upstream direction, surrounds valve-seat support 1 up to the level of the spherical equator of valve-closure member 7, for example. Jacket section 43 of gas-containing part 35 extends in intervening space 36 formed between gas-containing member 30 and valve-seat support 1, and due to its structural design, guarantees a defined gas feed. Jacket section 43 is not completely cylindrical, in so far as, for example, it has four areas 44 of larger diameter and four areas 45 of smaller diameter, which alternate in each case in the circumferential direction of jacket section 43. In the installed state of gas-containing part 35, it then looks thus that annular intervening space 36 is utilized in its entire radial width, since areas 45 of smaller diameter abut against valve-seat support 1, and are securely joined to it by welded seams, for example, while areas 44 of larger diameter extend with clearance along the inner wall of gas-containing member 30 in feed-through opening 32.

Formed between valve-seat support 1 and areas 44 of larger diameter of jacket section 43 are an equal number of gas-intake channels 47, corresponding to the number of these areas 44, thus, e.g., four gas-intake channels 47 which run axially, evenly spaced, in the circumferential direction about valve-seat support 1. Bottom section 42 of gas-containing part 35 runs with an axial clearance with respect to the downstream end face of valve-seat support 1, so that formed between bottom section 42 and this end face is an annular, radially running flow channel 48 which joins up with gas-intake channels 47 and is traversed radially by gas. Thereupon, the gas flows largely axially upstream in a ring channel 49 between insertion member 38, which upstream of bottom section 42 has a conical outer contour tapering toward spray-orifice plate 21, and the wall of longitudinal opening 3 in valve-seat support 1, up to the deflection of the flow at spray-orifice plate 21 in the radial direction.

The metering of the gas for improved preparation of the fuel emerging from spray orifices 25 of spray-orifice plate 21 is effected via an annular gas gap 50, whose axial extent is yielded by the distance of insertion member 38 from spray-orifice plate 21. The axial dimension of the extension of annular gas gap 50 forms the metering cross-section for the gas, e.g., preparation air, streaming in from ring channel 49. The fed gas flows through narrow annular gas gap 50 to a mixture spray orifice 51 provided in insertion member 38, centrically and concentrically to longitudinal valve axis 2 and near spray-orifice plate 21, and strikes there upon the fuel dispensed through the, e.g., two or four spray orifices 25. Due to the small axial extension of annular gas gap 50, the fed gas is sharply accelerated, and atomizes the fuel to be particularly fine.

A gasket 55 provides for a seal between gas-containing member 30 and insertion member 38 between the outer contour of insertion member 38 and the inner wall of gas-containing member 30 below bottom section 42, bottom section 42 directly delimiting an annular groove necessary for accommodating gasket 55. Insertion member 38 is distinguished by a drip-off geometry at the downstream end of preparation attachment 40. A drip-off crown 56, contiguous downstream to the lower end face, having a plurality of jags, provides improved drip-off behavior of the fuel (particularly during operation without gas), since the fuel cannot converge to form large drops. For example, the jags of drip-off crown 56 are in the shape of triangular teeth which taper to a point in the downstream direction, whereas the free areas formed between the jags are triangular in reverse, thus become wider in the downstream direction.

From the already mentioned gas-feed device, not shown, which, for example, is constructed in the form of a gas-intake channel, the gas enters, via a plurality of intake ports 58 completely penetrating the wall of gas-containing member 30, into intervening space 36 formed between valve-seat support 1 and gas-containing member 30 in feed-through opening 32. Provided for the sealing between the periphery of the fuel-injection valve and a valve mount, not shown, an induction pipe of the internal combustion engine for example, are two gaskets 60 at the outer periphery of the spray-side end. The upper gasket 60 facing magnetic coil 10 is arranged in an annular groove 61 introduced in plastic extrusion coat 15. On the other hand, the lower gasket 60 facing preparation attachment 40 is provided directly at gas-containing member 30. Gas-containing member 30, deep-drawn, e.g., from sheet metal has, in its middle, axial extension area, two circumferential toruses 62 disposed outwardly, transversely to the axial tubular extension, which are formed by folding. The two toruses 62, together with the outer wall of gas-containing member 30, form a further annular groove 63 in this area.

Gas-containing member 30 is secured at the lower, downstream end of plastic extrusion coat 15 by a snap-fit, catch or clip connection. To that end, for example, plastic extrusion coat 15 is formed in such a way at its lower end facing gas-containing member 30, that one circumferential projection, or a plurality of projections 65 are provided, projecting outwardly like saw-teeth, distributed at the periphery. As connecting means corresponding to projections 65, gas-containing member 30, above intake ports 58, has a plurality of elastic clips 66 distributed at the periphery, disposed inwardly toward valve-seat support 1, which grip projections 65 from behind. It is not necessary to achieve imperviousness at this connecting point, so that because of their simplicity, the indicated connecting possibilities can be utilized very well. The connection area can also be modified, metallic gas-containing member 30 always being secured by a non-integral jointing method to corresponding connection means on plastic extrusion coat 15, however. For example, projections 65 can be snapped into openings or windows of gas-containing member 30. In particular, quick-release hooks, not shown, can be formed in addition on gas-containing member 30.

Figure 2:
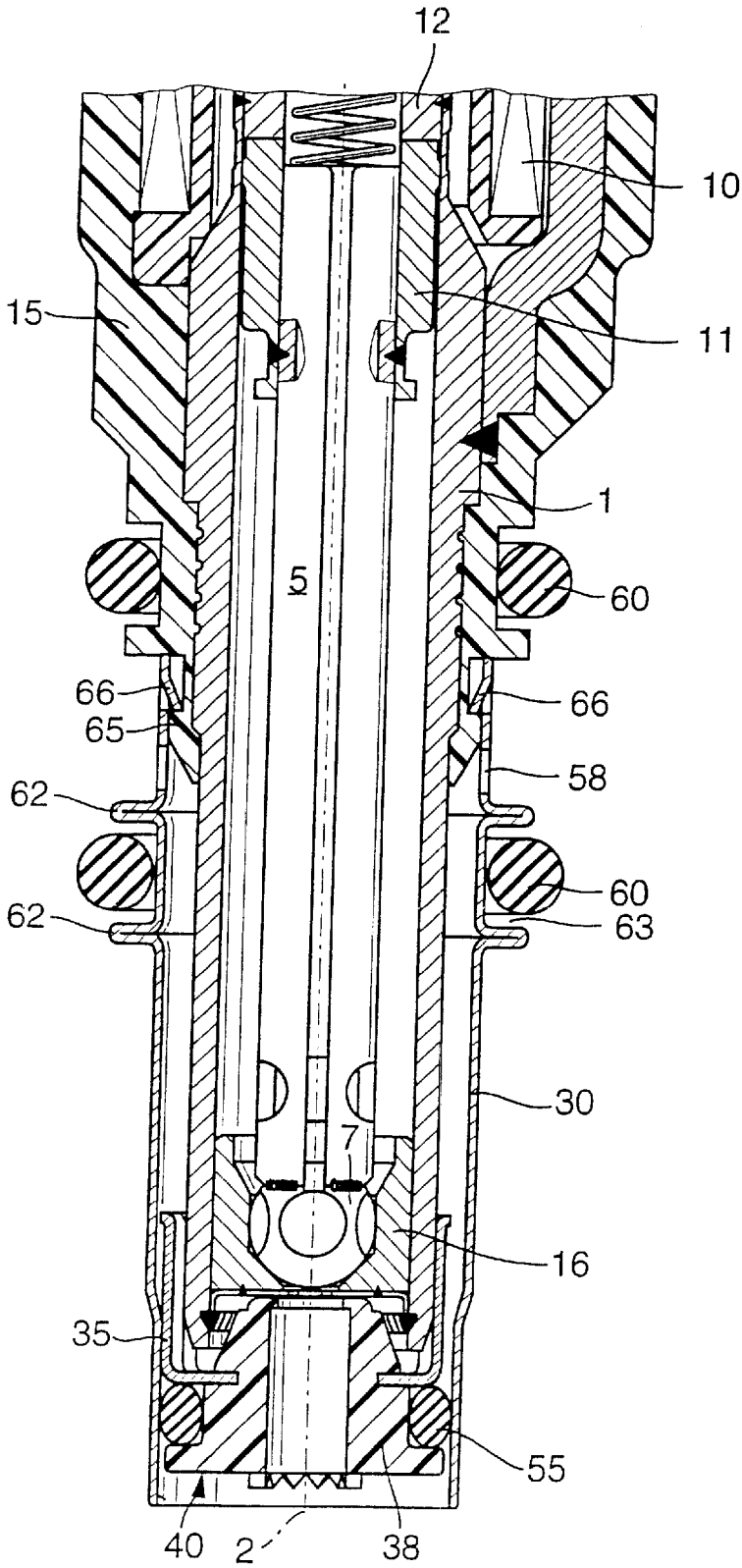
FIG. 2 shows the spray-side end of a fuel-injection valve as a second exemplary embodiment of a gas enclosure having a spray point arranged upstream according to the present invention.

As FIG. 2 shows, the length of gas-containing member 30 can be varied very easily. Accordingly, the two folded toruses 62 can also be premolded at a different location of gas-containing member 30. A very extended gas-containing member 30 is advantageous if the intention is to provide for a spray point far upstream. Only valve-seat support 1 and valve needle 5 need to be lengthened according to the length of gas-containing member 30; all other components of the fuel-injection valve can be used in identical manner. For example, in the case of the valve according to FIG. 2, the spray area (preparation attachment 40) clearly extends into the intake passage of the internal combustion engine. Wetting the wall of the intake passage can be easily avoided by a well-directed spray onto one or more intake valves thus made possible, which means the exhaust-gas emission from the internal combustion engine and the fuel consumption are reduced.

What is claimed is:

1. A fuel-injection valve for a fuel-injection system of an internal combustion engine, comprising:

a jacketing member;

a valve housing being at least partially enclosed by the jacketing member;

a valve-closure member axially moving along a longitudinal valve axis of the fuel-injection valve;

a valve-seat member having a valve-seat surface which interacts with the valve-closure member;

at least one spray orifice situated downstream of the valve-seat surface;

an arrangement situated at a downstream end of the fuel-injection valve, the arrangement producing a fuel-gas mixture; and a gas-containing member completely surrounding the arrangement in a circumferential direction, the gas-containing member being composed of a metal material, the gas-containing member and the jacketing member being joined via a non-integral connection, wherein:

no portion of the jacketing member axially overlaps the arrangement.

2. The fuel-injection valve according to the claim 1, wherein the jacketing member includes a plastic extrusion coat.

3. The fuel-injection valve according to claim 1, wherein the gas-containing member is produced from a sheet metal using a deep drawing procedure.

4. The fuel-injection valve according to claim 1, wherein the gas-containing member has one of a sleeve shape and a tubular shape with an inner feed-through opening.

5. The fuel-injection valve according to claim 1, wherein the non-integral connection is one of a snap-fit connection, a catch connection and a clip connection.

6. The fuel-injection valve according to claim 1, further comprising:

at least one intake port providing a gas to flow in, the at least one intake port situated in the gas-containing member.

7. The fuel-injection valve according to claim 1, wherein the arrangement includes a preparation attachment, the preparation attachment composed of a cup-shaped metallic gas-containing part and a plastic insertion member, the plastic insertion member including a mixture spray orifice.

8. The fuel-injection valve according to claim 1, wherein the gas-containing member further completely surrounds the arrangement in an axial direction.

9. The fuel-injection valve according to claim 2, wherein the plastic extrusion coat has a particular end which faces the gas-containing member, the fuel-injection valve further comprising:

at least one circumferential projection projecting outwardly, the at least one circumferential projection being distributed over a circumference and having a shape of a saw-tooth.

10. The fuel-injection valve according to claim 9, wherein the gas-containing member includes a plurality of clips which are distributed at a periphery, the plurality of clips situated at the particular end and disposed inwardly toward the valve housing, the plurality of clips gripping the at least one circumferential projection from a back side of the at least one circumferential projection.

11. The fuel-injection valve according to claim 5, wherein a plastic extrusion coat of the jacketing member has a particular end which faces the gas-containing member, the fuel-injection valve further comprising:

at least one circumferential projection projecting outwardly, the at least one circumferential projection being distributed over a circumference and having a shape of a saw-tooth.

12. The fuel-injection valve according to claim 11, wherein the gas-containing member includes a plurality of clips which are distributed at a periphery, the plurality of clips situated at the particular end and disposed inwardly toward the valve housing, the plurality of clips gripping the at least one circumferential projection from a back side of the at least one circumferential projection.

13. A fuel-injection valve for a fuel-injection system of an internal combustion engine, comprising:

a jacketing member;

a valve housing being at least partially enclosed by the jacketing member;

a valve-closure member axially moving along a longitudinal valve axis of the fuel-injection valve;

a valve-seat member having a valve-seat surface which interacts with the valve-closure member;

at least one spray orifice situated downstream of the valve-seat surface;

an arrangement situated at a downstream end of the fuel-injection valve, the arrangement producing a fuel-gas mixture; and a gas-containing member completely surrounding the arrangement in a circumferential direction, the gas-containing member being composed of a metal material, the gas-containing member and the jacketing member being joined via a non-integral connection, wherein:

the gas-containing member has one of a sleeve shape and a tubular shape with an inner feed-through opening, and an outer periphery of the gas-containing member is situated transversely to an axial tubular extension of the gas-containing member, two outwardly disposed circumferential toruses being situated at the outer periphery, the two circumferential toruses being formed by a folding procedure, the two circumferential toruses together with an outer wall of the gas-containing member forming an annular groove.

* * * * *